2/11/86 XR 4,569,751

United States Patent [19]

Eidt, Jr. et al.

[11] Patent Number: 4,569,751

[45] Date of Patent: Feb. 11, 1986

[54] COMBINATION COKING AND HYDROCONVERSION PROCESS

[75] Inventors: Clarence M. Eidt, Jr., Chatham, N.J.; Clyde L. Aldridge; Roby Bearden, Jr., both of Baton Rouge, La.

[73] Assignee: Exxon Research and Engineering Co., Florham Park, N.J.

[21] Appl. No.: 676,863

[22] Filed: Nov. 30, 1984

Related U.S. Application Data

[63] Continuation-in-part of Ser. No. 561,469, Dec. 14, 1983, abandoned.

[51] Int. Cl.[4] ..... C10G 69/06; C10G 69/10; C10G 69/00

[52] U.S. Cl. ..... 208/53; 208/55; 208/54; 208/68; 208/50

[58] Field of Search ..... 208/54, 53, 50, 55, 208/131, 111, 68

[56] References Cited

U.S. PATENT DOCUMENTS

| | | | |
|---|---|---|---|
| 2,614,067 | 10/1952 | Reed et al. . | |
| 2,888,393 | 5/1959 | Ballard et al. . | |
| 3,238,117 | 3/1966 | Arey, Jr. et al. | 208/53 |
| 3,245,900 | 4/1966 | Paterson . | |
| 3,269,958 | 8/1966 | Gatsis | 208/216 R |
| 3,684,689 | 8/1972 | Patton et al. | 208/54 |
| 4,134,825 | 1/1979 | Bearden, Jr. et al. . | |
| 4,178,227 | 12/1979 | Metrailer et al. . | |
| 4,204,943 | 5/1980 | Metrailer et al. . | |

OTHER PUBLICATIONS

Bridge et al., "Residuer Processes Proven" Oil and Gas Journal, Jan. 19, 1981, p. 85–98.

*Primary Examiner*—D. E. Gantz
*Assistant Examiner*—Chung K. Pak
*Attorney, Agent, or Firm*—Marthe L. Gibbons

[57] ABSTRACT

A carbonaceous feed, such as a heavy hydrocarbonaceous oil or coal and mixtures thereof, is upgraded by a combination coking and catalytic slurry hydroconversion process.

12 Claims, 1 Drawing Figure

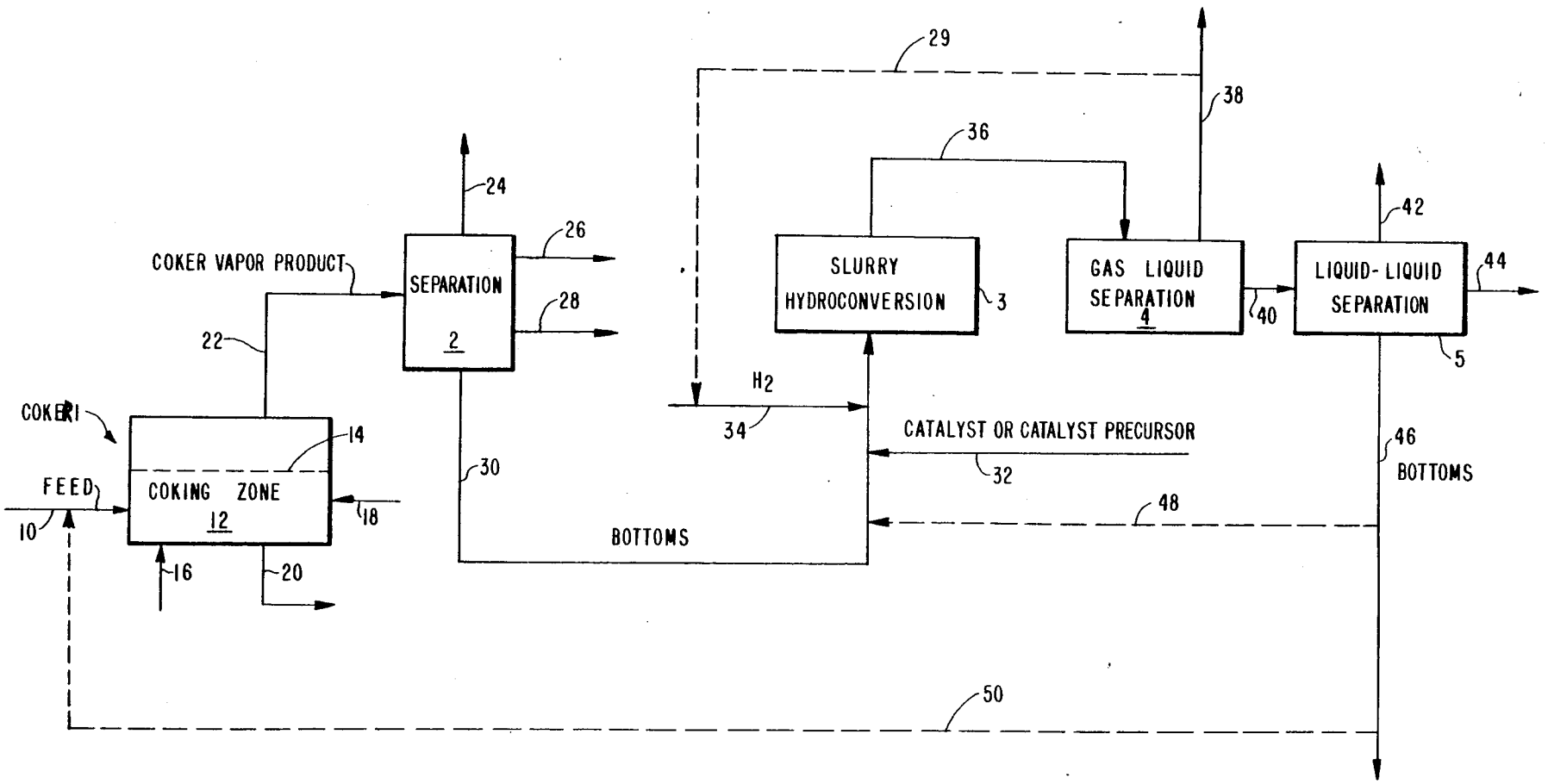
LIQUID-LIQUID SEPARATION
5
44
42
46
BOTTOMS
GAS LIQUID SEPARATION 4
40
38
SLURRY HYDROCONVERSION
3
36
29
CATALYST OR CATALYST PRECURSOR
32
48
50
H2
34
BOTTOMS
SEPARATION 2
26
28
24
30
COKER VAPOR PRODUCT
22
COKING ZONE 12
14
18
20
16
COKER
FEED
10

COMBINATION COKING AND HYDROCONVERSION PROCESS

CROSS REFERENCE TO RELATED APPLICATIONS

This application is a continuation-in-part application of Ser. No. 561,469, filed Dec. 14, 1983, now abandoned, the teachings of which are hereby incorporated by reference.

BACKGROUND OF THE INVENTION

1. Field of the Invention

The present invention relates to an integrated coking and hydroconversion process for upgrading carbonaceous materials.

2. Description of the Prior Art

Coking is a well-known process. The fluid coking process is described, for example, in U.S. Pat. No. 2,881,130, the teachings of which are hereby incorporated by reference. The fluid coking process can be conducted with or without recycle of the heavy normally liquid constituents of the coking product. When the heavy normally liquid constituents of the coker product are not recycled to the coking zone, the process is referred to as "once-through" coking. Integrated fluid coking and coke gasification processes are also known and disclosed, for example, in U.S. Pat. Nos. 3,702,516; 3,759,676, and 4,325,815, the teachings of which are hereby incorporated by reference. Delayed coking is a well-known process in which a hydrocarbonaceous oil is heated to a cracking temperature and then passed into a coking drum to produce a vapor phase product, including hydrocarbons and coke. The drum is decoked by hydraulic or by mechanical means. See *Hydrocarbon Processing*, September 1980, page 153.

U.S. Pat. No. 4,134,825 discloses a catalytic slurry hydroconversion process conducted at a pressure of 500 to 5000 psig and at elevated temperatures. The catalyst is produced in the oil feed from a catalyst precursor.

The term "hydroconversion" is used herein to designate a process conducted in the presence of hydrogen in which at least a portion of the heavy constituents of a hydrocarbonaceous oil is converted to lower boiling products while simultaneously reducing the concentration of nitrogenous compounds, sulphur compounds and metallic contaminants.

U.S. Pat. No. 3,684,689 discloses fluid coking a residuum at a pressure above 150 psig. The coker bottoms are passed to a hydrocracking zone. The stream passed to the hydrocracking zone is a gas oil (see column 3, line 74 and column 6, lines 72–73).

U.S. Pat. No. 2,614,067 discloses coking a topped crude oil in a fluid coker. A gas oil fraction from a fractionator is used as absorber oil in an absorber. The absorber bottoms are passed to a slurry hydrogenation reactor. The absorber bottoms do not seem to include constituents boiling above 1050° F.

U.S. Pat. No. 3,245,900 discloses coking a residuum and sending the coker distillate to a hydrocracking zone.

U.S. Pat. No. 2,888,393 discloses fluid coking at a pressure of 200 to 2000 psig and hydrogenating the entire coker effluent at a pressure ranging from 200 to 2000 psig.

U.S. Pat. Nos. 4,204,943; 4,178,227, and 4,169,038 disclose combination hydroconversion and coking in which the bottoms portion of the hydroconverted product is used as feed to the coking zone.

It has now been found that an integrated coking and hydroconversion process in which the coker bottoms, including materials boiling above 1050° F., are further converted in a catalytic slurry hydroconversion stage, will provide advantages that will become apparent in the ensuing description.

All boiling points referred to herein are atmospheric pressure equivalent boiling points unless otherwise specified.

SUMMARY OF THE INVENTION

In accordance with the invention, there is provided an integrated coking and hydroconversion process which comprises the steps of:

(a) treating a carbonaceous feed having a Conradson carbon content of at least 5 weight percent in a coking zone at coking conditions, including a pressure ranging from zero to about 100 psig, to produce coke and a vapor phase product, including hydrocarbons comprising constituents boiling above 1050° F.;

(b) separating a heavy bottoms fraction having a Conradson carbon content of at least about 5 weight percent, including said constituents boiling above 1050° F., from said hydrocarbons;

(c) adding a hydroconversion catalyst or hydroconversion catalyst precursor to at least a portion of said heavy bottoms fraction to form a mixture, and (d) subjecting at least a portion of said mixture of step (c) to hydroconversion conditions in the presence of hydrogen in a slurry hydroconversion zone to produce a hydroconverted oil.

BRIEF DESCRIPTION OF THE DRAWING

The FIGURE is a schematic flow plan of one embodiment of the invention.

DESCRIPTION OF THE PREFERRED EMBODIMENT

The integrated process of the present invention comprises coking and slurry hydroconversion of the coker bottoms. The coking process may be fluid coking or delayed coking. Preferably, the coking process is fluid coking. Delayed coking conditions are well known and include a temperature ranging from about 775° F. to about 1000° F. and a pressure ranging from about 10 to about 200 psig. The preferred embodiment will be described with reference to the accompanying FIGURE.

Referring to the FIGURE, a carbonaceous material is passed by line 10 into coking zone 12 in coker 1 in which is maintained a fluidized bed of solids, e.g., coke particles of 40 to 1000 microns in size shown as having an upper level 14.

Carbonaceous Feeds

Suitable feeds for introduction into coking zone 12 include heavy hydrocarbonaceous oils; heavy and reduced petroleum crude oil; petroleum atmospheric distillation bottoms; petroleum vacuum distillation bottoms; pitch; asphalt; bitumen; other heavy hydrocarbon residues; tar sand oil; shale oil; coal; coal slurries; liquid products derived from coal liquefaction processes, including coal liquefaction bottoms, and mixtures thereof. Typically, such feeds have a Conradson carbon content of at least 5 weight percent, generally from about 5 to about 50 weight percent, preferably above 7 weight percent (as to Conradson carbon residue, see ASTM Test D189-65). Preferably the feed is a hydrocarbonaceous oil comprising at least 10 weight percent of materials boiling above 1050° F. A fluidizing gas, e.g., steam, is admitted at the base of coker 1 through line 16 in an amount sufficient to obtain a superficial fluidizing gas velocity in the range of 0.5 to 5 feet per second. The fluidizing gas may comprise steam, vaporized normally liquid hydrocarbons, normally gaseous hydrocarbons, hydrogen, hydrogen sulfide and mixtures thereof. Typically, the fluidizing gas will comprise steam. Solids at a temperature above the coking temperature, for example, 100 to 1000 Fahrenheit degrees above the actual operating temperature of the coking zone are admitted to coker 1 by line 18 in an amount sufficient to maintain the coking temperature in the range of about 850° to about 1400° F., preferably from about 900° to about 1200° F. The pressure in the coking zone is maintained suitably in the range of about zero to about 100 pounds per square inch gauge, (psig), preferably in the range of about 5 to about 45 psig. The lower portion of the coker serves as a stripping zone to remove occluded hydrocarbons from the solids. A stream of stripped solids is withdrawn from coker 1 by line 20 for passage to a gasifier (not shown) or to a heater (not shown) to heat the solids. The heater may be operated as a conventional coker burner as disclosed in U.S. Pat. No. 2,881,130, the teachings of which are hereby incorporated by reference. Alternatively, the heater may be operated as a heat exchange zone such as disclosed in U.S. Pat. Nos. 3,661,543; 3,702,516, and 3,759,676, the teachings of which are hereby incorporated by reference. The heated solids are recycled to coker 1 by line 16 to supply heat for the endothermic coking reaction. The vaporous coker product, which comprises light hydrocarbons and heavy hydrocarbons, including materials boiling above 1050° F., is passed by line 22 to a separation zone 2 which may be a scrubbing zone or a fractionation zone. In separation zone 2, the coker vapor phase product is separated into a gas removed by line 24, a light boiling hydrocarbonaceous stream removed by line 26, and an intermediate boiling fraction removed by line 28. A heavy bottoms fraction, including materials boiling above 1050° F., is removed by line 30. The heavy bottoms fraction removed by line 30 has a Conradson carbon content of at least 5 weight percent, preferably at least 7 weight percent and generally comprises at least about 10 weight percent materials boiling above 1050° F. The initial boiling point of the heavy bottoms fraction 30 may range from about 650° to about 1050° F. Preferably, the initial boiling point is at least about 975° F. A catalyst or catalyst precursor is added by line 32 to the bottoms fraction carried in line 30. Alternatively, the catalyst or catalyst precursor may be introduced directly into slurry hydroconversion zone 3. A hydrogen-containing gas is introduced by line 34 into line 30 or directly into hydroconverson zone 3.

The Hydroconversion Catalyst

The hydroconversion catalyst introduced into heavy bottoms fraction 30 to form a slurry may be any suitable hydroconversion catalyst or catalyst precursor suitable for use in slurry processes. The catalyst may comprise a group IVB, VB, VIB, VIIB or VIII metal, metal oxide or metal sulfide or mixtures thereof of the Periodic Table of Elements and may be supported or unsupported catalysts. The Periodic Table of Elements referred to herein is in accordance with the table of E. H. Sargent and Company, copyright 1962, Dyna Slide Company. Instead of a preformed catalyst, a catalyst precursor may be used such as an oil soluble or oil dispersible or a thermally decomposable metal compound such as, for example, the catalyst precursor described in U.S. Pat. No. 4,226,742, the teachings of which are hereby incorporated by reference. Catalysts comprising cobalt, molybdenum, nickel, tungsten, iron and mixtures thereof on an alumina-containing support or on a carbonaceous support such as coal or coke are also suitable. The catalyst or catalyst precursor is added to the coker bottoms carried in line 30 by line 32. Alternatively, the catalyst or catalyst precursor may be introduced directly into slurry hydroconversion zone 3. The amount of catalyst or catalyst precursor added to the heavy coker bottoms will vary widely depending on the type of catalyst or catalyst precursor used. Preferred catalysts are carbonaceous solids having an average particle size of less than 10 microns in diameter or the ashes thereof such as the catalysts described in U.S. Pat. No. 4,204,943; U.S. Pat. No. 4,169,038 and U.S. Pat. No. 4,178,227, the teachings of which are hereby incorporated by reference. These catalysts may be derived from the metals-containing fines of a coke gasification process.

Slurry Hydroconversion Operating Conditions

Suitable conditions in the slurry hydroconversion zone are summarized in Table I.

TABLE I

| Conditions | Broad Range | Preferred Range |
|---|---|---|
| Temperature, °F. | 650 to 1000 | 800 to 900 |
| Hydrogen Partial Pressure, psig | 100 to 5000 | 300 to 2000 |

Although it is preferred to operate at higher pressure, relatively low pressures can be used to obtain a significant conversion when utilized in combination with certain temperatures. Table II summarizes preferred combination conditions.

TABLE II

| Hydroconversion $H_2$ Partial Pressure, psig | 100–499 | 500–999 | 1000–2000 |
|---|---|---|---|
| Temperature, °F. | | | |
| Broad | 750–820 | 750–875 | 750–900 |
| Preferred | 760–800 | 780–840 | 800–850 |

In the slurry hydroconversion zone, at least 10 weight percent, preferably at least 50 weight percent, more preferably at least 75 weight percent of the materials boiling above 1050° F. that are present in the heavy bottoms fraction subjected to slurry hydroconversion conditions is converted to lower boiling products.

The hydroconversion zone effluent is removed by line 36 and passed into a gas-liquid separation zone 4 wherein the normally gaseous phase is separated from a normally liquid phase. The gaseous phase is removed from separation zone 4 by line 38. Alternatively, the gaseous phase, which comprises hydrogen, may be recycled by line 29, preferably after removal of undesired constituents, to the slurry hydroconversion zone via line 34. The normally liquid phase, which comprises the hydroconverted hydrocarbonaceous oil having a decreased Conradson carbon content, is passed by line 40 to separation zone 5 for fractionation by conventional means, such as distillation, into various fractions such as light, medium boiling and heavy bottoms fractions. The light fraction is removed by line 42. The medium boiling fraction is removed by line 44. The heavy bottoms fraction is removed by line 46 and, if desired, at least a portion of the bottoms fraction may be recycled to hydroconversion zone 3 by line 48 and/or to coking zone 12 by line 50.

The following examples are provided to illustrate the invention.

EXAMPLE 1

Heavy Arabian vacuum residuum was subjected to fluid coking at a reactor temperature of 950° F. operating in a once-through mode to produce a coker product containing a 975+ °F. fraction. The inspections of the 975+ °F. fraction were as follows:

| | |
|---|---|
| API gravity at 60° F. | 1.65 |
| sulfur, wt. % | 5.7 |
| nitrogen, wt. % | 0.42 |
| Conradson carbon, wt. % | 23.7 |
| 1050+ °F. fraction, wt. %[a] | 75.5 |
| Ni, wppm | 7.0 |
| V, wppm | 30.0 |
| Fe, wppm | 13 |
| C, wt. % | 84.3 |
| H, wt. % | 9.0 |

[a]determined by ASTMD 1160 Distillation

This 975+ °F. fraction was subjected to hydroconversion reactions as described in the following examples.

EXAMPLE 2 (Run 879)

Sixty-six grams of 975+ °F. bottoms (containing 23.7% Conradson carbon) from distillation of the product of once-through coking of heavy Arabian residuum was charged to a 300 cc. Autoclave Engineers magnetically stirred autoclave. Also charged was a catalyst precursor concentrate containing 2000 wppm Mo prepared by mixing with heating to 300° F. for 15 minutes a 20% phosphomolybdic acid in phenol solution in 30.46 g of the 975+ °F. coker bottoms and 23.54 g of vacuum gas oil. This amount of charge and catalyst precursor concentrate gave a molybdenum concentration of 900 ppm on the total charge.

The autoclave was flushed with $H_2$, pressured with 38 psia of $H_2S$ and then pressured to 360 psig with hydrogen. The autoclave was then heated with stirring to 800° F. whereupon the total pressure was 495 psig and the hydrogen pressure was 443 psia. A flow of 0.26 l/min. $H_2$ as measured at atmospheric ambient conditions was established, and reaction conducted for 9 hr. At the end of this reaction time the hydrogen partial pressure in the autoclave as determined by subsequent analysis of the autoclave content gases was 432 psia.

After the 9 hr. reaction time the autoclave was blocked off and cooled. The flow through gas and the autoclave final gas were collected separately in butyl balloons, measured and analyzed by mass spectrometry to determine gas yields and hydrogen partial pressure in the autoclave.

The autoclave contents were diluted with 360 g of toluene and filtered to recover toluene insoluble coke and liquid separately. The coke weighed, after vacuum oven drying at 100° C., 0.49 g.

The toluene solution of product liquid was vacuum distilled to 975° F. cut point and 16.3 g of material boiling above 975° F. was recovered as a bottoms. This unconverted 975+ °F. material had a Conradson carbon content of 58.34 percent. The total $C_4$+ liquid product amounted to 90.07 weight percent on total feed charge and contained 10.6 weight percent Conradson carbon.

The 975+ °F. conversion to 975− °F. liquid and gas was 83 percent, the $C_1$-$C_3$ gas yield was 9.42 percent on total feed, the Conradson carbon conversion was 58 percent, the coke yield on 975+ °F. feed was 0.51 percent.

EXAMPLE 3 (Run 874)

An experiment was conducted similar to Example 2, except the reaction time was 3 hr. and the charge of catalyst precursor concentrate was 15.0 g and the charge of 975+ °F. coker bottoms was 105.0 g to give a molybdenum concentration on total feed of 250 wppm. The initial and final $H_2$ partial pressures were determined to be 447 psia and 402 psia, respectively.

The 975+ °F. conversion to 975− °F. liquid and gas was 71 percent. The $C_1$-$C_3$ gas yield was 5.17 percent on total feed, the Conradson carbon conversion was 31 percent, the coke yield on 975+ °F. feed was 0.19 percent.

EXAMPLE 4 (Run 875)

An experiment was conducted similar to Example 3, except that the reaction time was 6 hr. The initial and final hydrogen partial pressures were determined to be 447 and 412 psia, respectively.

The 975+ °F. conversion to 975− °F. liquid and gas was 75 percent. The $C_1$-$C_3$ gas yield was 7.83 percent on total feed. The Conradson carbon conversion was 42 percent. The coke yield on 975+ °F. feed was 0.62 percent.

EXAMPLE 5 (Run 877)

An experiment was conducted similar to Example 4, except that the temperature was 780° F. and the total pressure was 300 psig. The initial and final $H_2$ partial pressures were determined to be 248 and 275 psia, respectively.

The 975+ °F. conversion to 975− °F. liquid and gas was 67 percent. The $C_1$-$C_3$ gas yield was 3.83 percent on total field. The Conradson carbon conversion was 27 percent. The coke yield on 975+ °F. feed was 0.67 percent.

EXAMPLE 6 (Run 880)

An experiment was conducted similar to Example 2, except that the temperature was 780° F. and the total pressure was 400 psig. The initial and final hydrogen partial pressures were determined to be 348 and 373 psia, respectively.

The 975+ °F. conversion to 975− °F. liquid and gas was 75 percent. The $C_1$-$C_3$ gas yield was 5.52 percent on total feed. The Conradson carbon conversion was 53 percent. The coke yield on 975+ °F. feed was 0.43 percent.

EXAMPLE 7 (Run 872)

An experiment was conducted that was similar to the experiment of Example 3, except that the temperature of reaction was 830° F. and the total pressure was 1500 psig. The initial and final hydrogen partial pressures were determined to be 1415 psia and 1171 psia, respectively. The 975+ °F. conversion to 975− °F. liquid and gas was 79 percent. The $C_1$-$C_3$ gas yield was 7.79 percent on total feed. The Conradson carbon conversion was 58 percent. The coke yield on 975+ °F. feed was 0.14 percent.

EXAMPLE 8

One hundred and twenty grams of 975+ °F. once-through coker bottoms derived from Heavy Arab vacuum resid was charged to a 300 cc Autoclave Engineers magnetically stirred autoclave together with 0.60 g of metals-containing carbonaceous fines derived from gasification of petroleum coke. The autoclave was pressure tested and flushed with hydrogen. The pressure was raised to 150 psig with $H_2S$ and then to 1400 psig with $H_2$ at room temperature, then heated to 830° F. with stirring and reaction conducted at that temperature at 2100 psig for three hours. A hydrogen flow was added during the course of reaction so as to maintain an exit gas flow of 0.36 l/min as measured by a wet test meter at room temperature.

After the reaction period the autoclave was cooled, the autoclave gases collected, measured and analyzed. The autoclave contents were washed out with 360 g of toluene and the solution filtered to isolate the solids. There was a net production of 0.41 g of toluene insoluble. The toluene solution was distilled to recover the 975+ °F. unconverted material which weighed 24.0 g and had a Conradson carbon content of 55.95. The total $C_4$+ liquid product amounted to 91.08 weight percent on feed charge and contained 12.3 weight percent Conradson carbon. These results correspond to conversion of 79.7% 975+ °F. material to 975− °F. oil plus gas and 53.9% Conradson carbon conversion. The $C_1$-$C_3$ gas production amounted to 8.58 weight percent on feed.

What is claimed is:

1. An integrated coking and hydroconversion process which comprises the steps of:

(a) treating a carbonaceous feed having a Conradson carbon content of at least 5 weight percent in a coking zone at coking conditions, including a pressure ranging from zero to about 100 psig, to produce coke and a vapor phase product, including hydrocarbons boiling above 1050° F.;

(b) separating a heavy bottoms fraction having an initial boiling point ranging from about 650° F. to about 1050° F. and having a Conradson carbon content of at least about 5 weight percent, including said hydrocarbons boiling above 1050° F., from said vapor phase product;

(c) adding a hydroconversion catalyst or hydroconversion catalyst precursor to at least a portion of said heavy bottoms fraction to form a mixture, and (d) subjecting at least a portion of said mixture of step (c) to hydroconversion conditions, in the presence of hydrogen, in a slurry hydroconversion zone to produce a hydroconverted oil.

2. The process of claim 1 wherein said coking conditions include a temperature ranging from about 775° F. to about 1400° F.

3. The process of claim 1 wherein said hydroconversion conditions include a pressure ranging from about 100 to about 5000 psig and a temperature ranging from about 650° to about 1000° F.

4. The process of claim 1 wherein said hydroconversion conditions include a pressure ranging from about 100 to about 499 psig and a temperature ranging from about 750° to 820° F.

5. The process of claim 1 wherein said carbonaceous feed of said coking zone has a Conradson carbon content of at least about 7 weight percent.

6. The process of claim 1 wherein said heavy bottoms fraction has a Conradson carbon content of at least about 7 weight percent.

7. The process of claim 1 wherein said hydroconversion catalyst precursor is an oil soluble metal compound or a thermally decomposable metal compound.

8. The process of claim 1 wherein said hydroconversion catalyst comprises metals-containing fines derived from the gasification of coke.

9. The process of claim 1 wherein said heavy bottoms fraction of step (b), comprises at least about 10 weight percent materials boiling above 1050° F.

10. The process of claim 1 wherein at least 10 weight percent of the 1050° F.+ materials of said portion of heavy bottoms fraction are converted to lower boiling products.

11. The process of claim 1 wherein said coking zone is a delayed coking zone operated at delayed coking conditions, including a temperature ranging from about 775° to 1000° F.

12. The process of claim 1 wherein said coking zone is a fluid coking zone operated at fluid coking conditions, including a temperature ranging from 850° to about 1400° F.

* * * * *